US007490362B2

(12) United States Patent
Owen

(10) Patent No.: US 7,490,362 B2
(45) Date of Patent: Feb. 17, 2009

(54) BREAST FEEDING COVER

(76) Inventor: Jennifer Owen, 14 Butler Close, Menai, NSW (AU) 2234

( * ) Notice: Subject to any disclaimer, the term of this patent is extended or adjusted under 35 U.S.C. 154(b) by 364 days.

(21) Appl. No.: 10/597,888

(22) PCT Filed: Feb. 10, 2005

(86) PCT No.: PCT/AU2005/000158

§ 371 (c)(1),
(2), (4) Date: Aug. 10, 2006

(87) PCT Pub. No.: WO2005/074732

PCT Pub. Date: Aug. 18, 2005

(65) Prior Publication Data

US 2008/0155727 A1 Jul. 3, 2008

(30) Foreign Application Priority Data

Feb. 10, 2004 (AU) ..... 2004900620

(51) Int. Cl.
*A41D 1/20* (2006.01)

(52) U.S. Cl. ..... 2/104; 2/48

(58) Field of Classification Search ..... 2/104, 2/88, 48, 49.1–49.5, 46, 50, 51, 52, 207, 2/92, 114, 69.5, 69, 111, 247; D2/860–864, D2/823; 5/482, 485, 494
See application file for complete search history.

(56) References Cited

U.S. PATENT DOCUMENTS

| | | | | | |
|---|---|---|---|---|---|
| 471,903 | A | * | 3/1892 | Shelton | 2/88 |
| 573,618 | A | * | 12/1896 | Rice | 2/88 |
| 1,220,088 | A | * | 3/1917 | Gavin | 2/88 |
| 1,669,735 | A | * | 5/1928 | Bergstrom | 2/48 |
| D131,384 | S | * | 2/1942 | Wilker | D2/861 |
| 2,629,870 | A | * | 2/1953 | Hudson | 2/49.1 |
| 4,468,816 | A | | 9/1984 | Kaufer | |
| 4,964,172 | A | * | 10/1990 | Bollard | 2/104 |
| 5,035,006 | A | * | 7/1991 | Hetz et al. | 2/209.11 |
| 5,038,411 | A | | 8/1991 | St. Armand | |
| 5,570,474 | A | | 11/1996 | Berry et al. | |
| 5,592,692 | A | * | 1/1997 | Larson | 2/104 |
| 5,652,958 | A | | 8/1997 | Farrell-Mestas | |
| D400,339 | S | * | 11/1998 | Foor et al. | D2/861 |
| D405,940 | S | * | 2/1999 | Payne | D2/861 |
| 6,216,273 | B1 | | 4/2001 | Williams | |
| 6,301,713 | B1 | | 10/2001 | Aceves et al. | |
| 6,868,554 | B1 | * | 3/2005 | Melvin | 2/50 |
| 7,114,191 | B1 | * | 10/2006 | Butler-Penenberg | 2/104 |
| 2003/0172434 | A1 | * | 9/2003 | Dodge et al. | 2/104 |
| 2008/0034463 | A1 | * | 2/2008 | Ekelund et al. | 2/104 |

FOREIGN PATENT DOCUMENTS

| | | |
|---|---|---|
| CA | 2237876 A1 | 12/1999 |
| WO | 9211775 | 7/1992 |

* cited by examiner

*Primary Examiner*—Amy B Vanatta
(74) *Attorney, Agent, or Firm*—Brooks Kushman P.C.

(57) ABSTRACT

A cover for use in breast feeding or bottle feeding an infant is disclosed, wherein the 5 cover (11) is formed from a sheet of fabric or the like shaped so that it may be comfortably draped around a mother's torso during breast feeding in order to allow discrete breast feeding of an infant. The cover is provided with a single strap means (15) to fit over a shoulder of the mother to prevent the cover from falling away from the torso. The cover may also be provided with one or more pockets (18) to hold nursing pads and the like.

15 Claims, 7 Drawing Sheets

BREAST FEEDING COVER

FIELD OF THE INVENTION

The present invention relates to a cover for use in breast feeding infants.

BACKGROUND OF THE INVENTION

It is now becoming a more common practice for mothers to feed their infants in public. Changing life styles have meant that there is now a greater need (or at least preference) for women on the go to feed their infants in public. Whether socialising, shopping, travelling or even in business, more and more women find it necessary to feed their infants as and when required. No longer are infants forced to a particular feeding regime as was fashionable in the past, most mothers adopting the practice of feeding on demand. This means that babies who want to be fed, have to be fed then and there under whatever circumstances prevail.

Although there are sometimes limited facilities available for doing this, such as change rooms and so on in shopping complexes or rest rooms in restaurants and diners etc, most women would generally prefer to feed their infants in the company of their friends or family or generally do so in the environment they find themselves, rather than feeling they have to secret themselves away in some back room like a social outcast.

However, there remains to a large extent a stigma against breast feeding in public. This comes to some extent from the older generation unaccustomed to such activity in public. Although changing fashions have meant a relaxation in certain standards, including the acceptance of topless bathing at the beach, the problem remains that overt exposure of the female breast elsewhere can offend certain sectors of the public, even if only for the otherwise natural function of breast feeding. Coupled with the undesirable attention that this may also cause in certain situations or with certain individuals, most women generally feel some degree of self-consciousness or embarrassment in exposing themselves, even if only momentarily whilst placing an infant on their nipple. This is of course exacerbated to some extent by the need to partially undo or remove at least a portion of the garments the mother is wearing. Even though the infant, when once on the nipple, affords some general "protection" as far as further exposure of the breast is concerned, this can be readily broken by the infant suddenly pulling away leaving the mother more exposed than she had intended or would have wished.

Add to this, the particular bonding which takes place between mother and child during breast feeding, one can easily appreciate that even those who might otherwise feel comfortable with perhaps more explicit exposure for example at the beach, would by and large prefer some degree of privacy, or at least a more discrete situation, when feeding their infant.

There are also situations when it would be desirable to provide some sort of protection for the infant as well. This would also extend to bottle feeding as well as breast feeding. For example protection from the elements, including sun and wind and perhaps even a light shower of rain, would be desirable for the infant being fed. Such protection is also relevant when considering the mother herself, who in situations where the weather is colder for example, may find that she is disadvantaged by having to partially expose more of herself than the she would prefer given the prevailing weather.

Other difficulties also arise when one considers the various aspects of feeding an infant, not the least of which is the need to juggle various implements, whilst holding the baby and fiddling with clothing etc, including in the case of bottle feeding, the bottle itself, and in the case of breast feeding, say a nursing pad.

It would therefore be useful to provide a suitable cover which could be used by mothers when breast feeding an infant, so that they can accomplish that in a more discrete manner, and which would also be suitable in providing protection to the infant (or mother) from exposure to the elements during either breast feeding or bottle feeding. It would also be useful if such cover also provided additional features such as a suitable pocket or pockets to accommodate for example one or more nursing pads, so that they are on hand when most needed.

OBJECT OF THE INVENTION

It is therefore an object of the present invention to overcome or at least ameliorate some or all of the foregoing disadvantages, by providing a suitable cover for use in breast feeding an infant so as to provide a more discrete situation, and which is also suitable for use in bottle feeding situations. Preferably such cover would have additional advantages such as the provision of pockets as well as providing protection to mother and infant. At the very least, the invention provides an alternative to previously known techniques for breast feeding and/or bottle feeding of infants.

DISCLOSURE OF THE INVENTION

According to the present invention there is provided a cover for use in breast feeding or bottle feeding an infant, wherein the cover is formed from a sheet of fabric or the like shaped so that it may be comfortably draped around a mother's torso during breast feeding in order to allow discrete breast feeding of an infant, the cover being provided with a single strap means to fit over a shoulder of the mother to prevent the cover from falling away from the torso.

The strap may be permanently fixed to the cover, in which case an arm will be inserted through the space between the strap and cover so as to fit the cover to the mother by placing the strap over the shoulder. The strap may also be preferably provided with adjustment means, eg similar to adjustment means for a bra, so that it may fit a variety of sized women. With further advantage one or other end of the strap may be detachable from the cover to facilitate fitment or adjustment of the cover, or alternatively the strap may comprise two portions which can be joined in suitable fashion to form the shoulder strap in use, eg by using Velcro® attachment, tying or by utilising a buckle arrangement or the like.

Preferably the cover is provided with one or more pockets formed therein or otherwise attached thereto. The pockets may be any suitable size, but preferably they are able to accommodate at least one or more nursing pads. With advantage, pockets may be provided on opposite sides of the cover to allow versatility in use, ie by allowing the cover to be effectively reversible. Pockets may be formed by sewing or by other techniques including suitable bonding (eg heat bonding) or gluing of the fabric or fabrics from which the cover and pockets are formed.

The sheet of fabric forming the cover may be a single sheet of fabric or may itself be made from two or more plies of fabric or sheeting suitably joined about their periphery, or elsewhere as required, by known means including sewing, bonding or gluing. In this way, suitable fabrics may be chosen for the side presented against mother and infant, as opposed to the exterior surface. For example, the inner side may be a soft absorbent fabric, whilst the outer side may be a more resistant or non permeable fabric, eg one which is water proof or moisture resistant. Fabric in this sense includes not only conventional woven and knitted fabric structures, but also other textile fabrics including felts and non-woven fabrics, as well as flexible plastics sheeting and the like. For example so-called "space" blanket material having a shiny metallic like surface on one side may be considered as suitable, especially for outdoor use. Any reference to fabric is therefore meant to encompass any convention textile, or any other fabric or sheeting material which may used to drape over the body in similar fashion.

Although generally opaque fabrics may be the preferred choice of fabric to ensure totally discrete breast feeding, other choices of fabric are also possible, where some visual contact may be achieved between mother and infant without necessarily compromising the use of the cover. Of course, the cover itself may be draped in suitable fashion about the mother and infant so as to allow appropriate access, visual or otherwise, without entirely covering the infant depending on the required circumstance.

Preferably the cover is shaped in generally arcuate fashion ie being derived from a sector of a circle, comprising around one third to one half of a notional circle of fabric. In this arrangement, it will be found useful to have the shoulder strap attached at points on the cover along the sides corresponding to the radii of the sector and generally located in the vicinity of the centre of that notional circle. However, with advantage, the area around the attachment point of the shoulder strap may be usefully shaped so as to provide a more comfortable fit for the cover as it passes across the torso and thence around and under the armpit of the mother. This may be accomplished by providing a cut-out portion generally along one radii of the sector forming the overall shape of the cover. Variations on this arrangement are possible, the only criteria ultimately being the need to usefully cover the breast and suckling infant and provide reasonable comfort for the mother, without excess material trailing to the ground.

BRIEF DESCRIPTION OF THE DRAWINGS

A preferred embodiment of the invention is illustrated in the accompanying figures of which.

BEST MODE OF CARRYING OUT THE INVENTION

Figure 1:
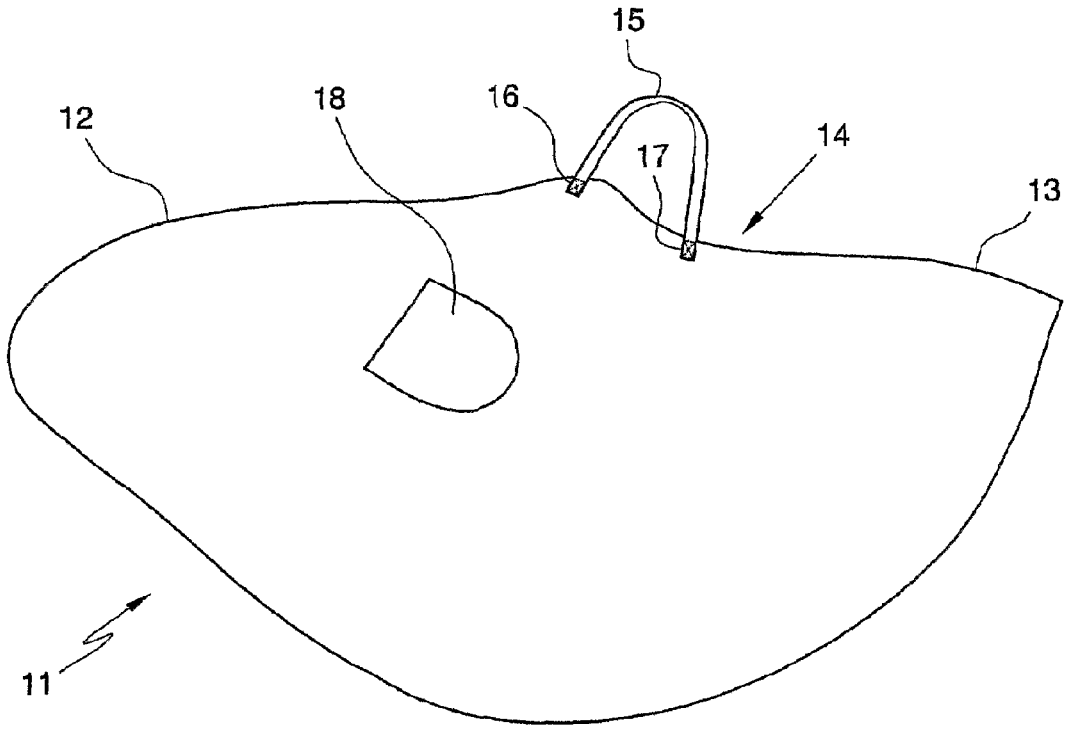
FIG. 1 is a general view of one embodiment of a cover for use in breast feeding an infant according to the invention.

Referring generally to FIG. 1, there is depicted a breast feeding cover generally referenced 11 having a shape corresponding generally to a sector. Along the radii 12 and 13 of the sector there is sufficient shaping, particularly in the region 14 where a portion of the sector is cut away, so that in use the cover 11 is more usefully able to wrap about the torso of the mother and pass comfortably under the arm pit, as shown in more detail in FIG. 3. A strap 15 is attached by suitable means, in this case sewing, at points 16 and 17 in this region so that an arm of the mother is passed between the strap 15 and body of the cover 11, the strap 15 passing over the shoulder to support the cover 11 and prevent it slipping down the torso during breastfeeding. Alternatively, the strap 15 may have means allowing it to be undone (not shown), so that in use the strap 15 is passed over the shoulder and rejoined, rather than having the arm inserted therethrough. The strap 15 may also be adjustable in length.

Figure 2:
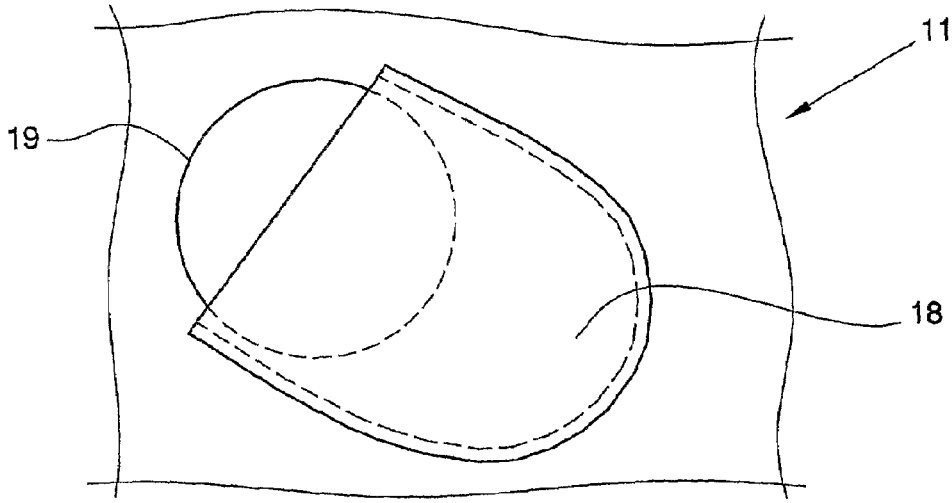
FIG. 2 is a detailed view of the pocket of the cover shown in FIG. 1, wherein a nursing pad is located therein.

Attached on one side of the cover 11 is a pocket 18, the detail of which is shown in FIG. 2. The pocket 18 is of sufficient size to accommodate one or more nursing pads 19, which the mother may use after completion of breast feeding. The pocket 18 is usefully located so that the mother can pull a nursing pad 19 therefrom discretely whilst the cover is draped about her as shown below in FIG. 3.

Figure 3:
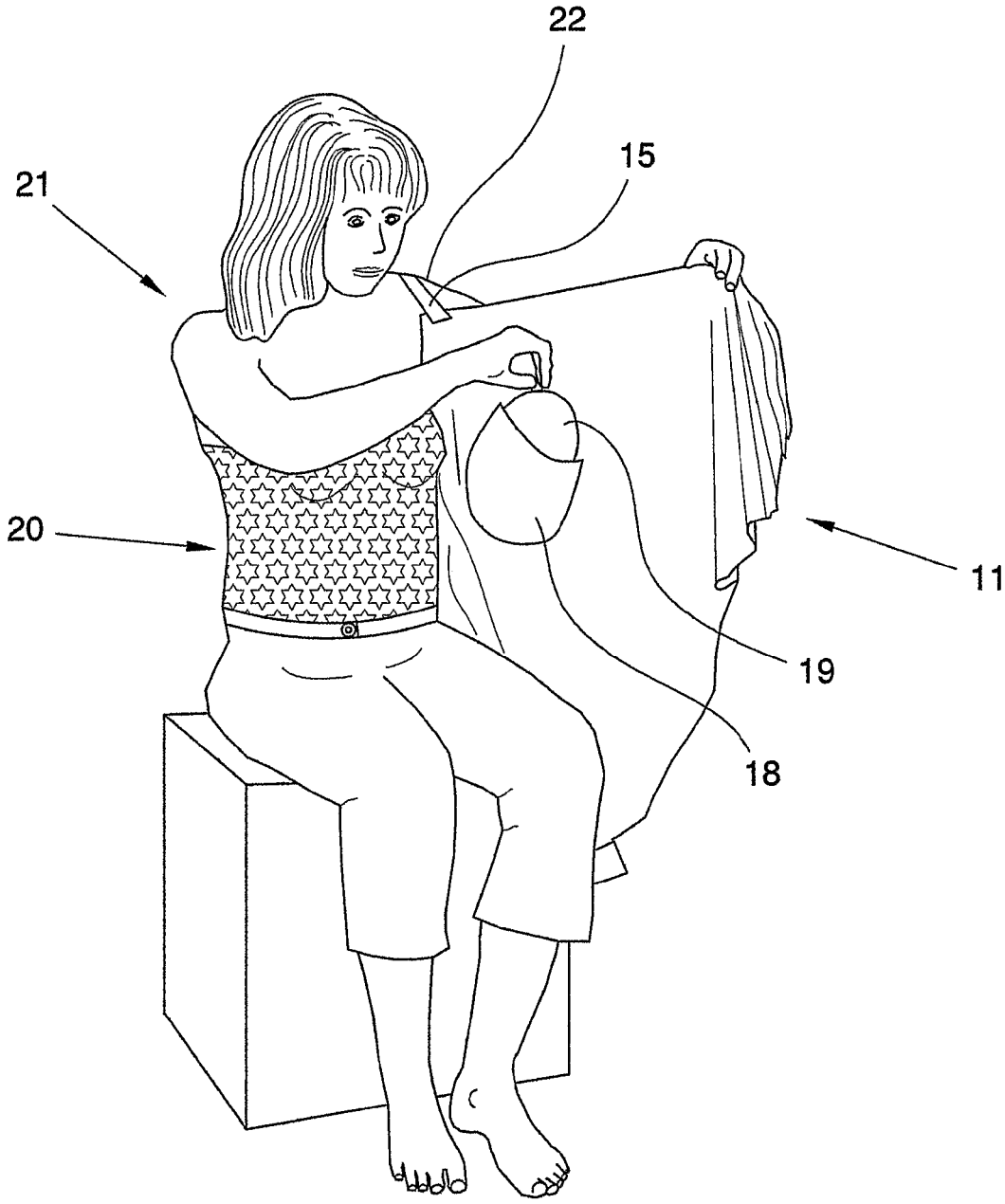
FIG. 3 is a photograph showing the cover of FIG. 1 being made ready to be fitted about the torso of a mother, showing the location of the pocket.
Figure 4A:
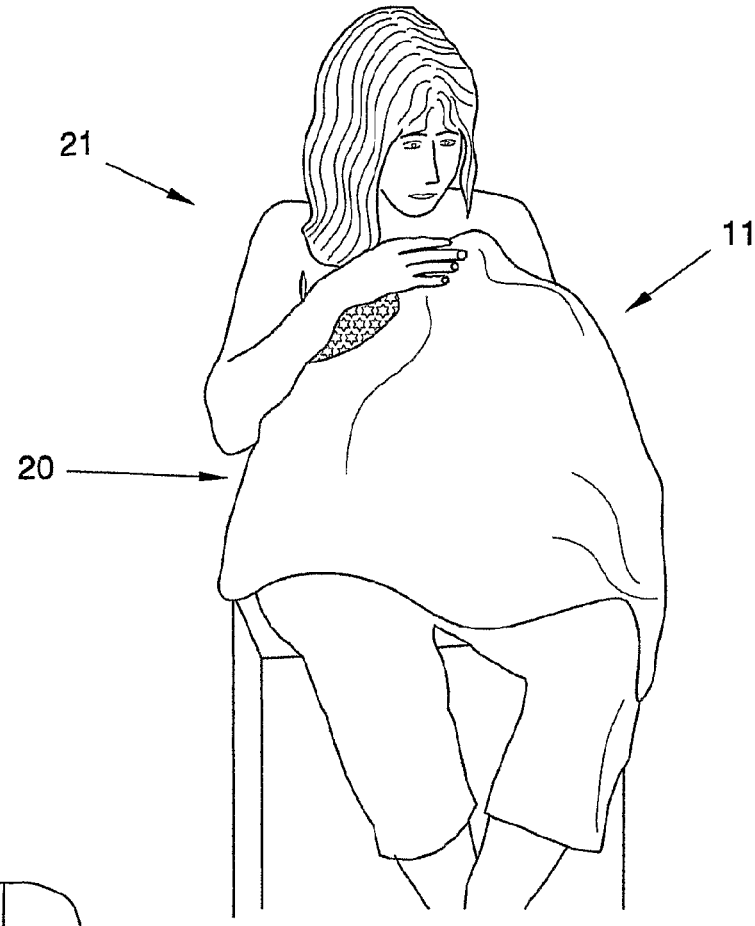
FIG. 4 is a series of photographs depicting the way in which the cover of FIG. 1 is generally utilised in breast feeding.
Figure 4B:
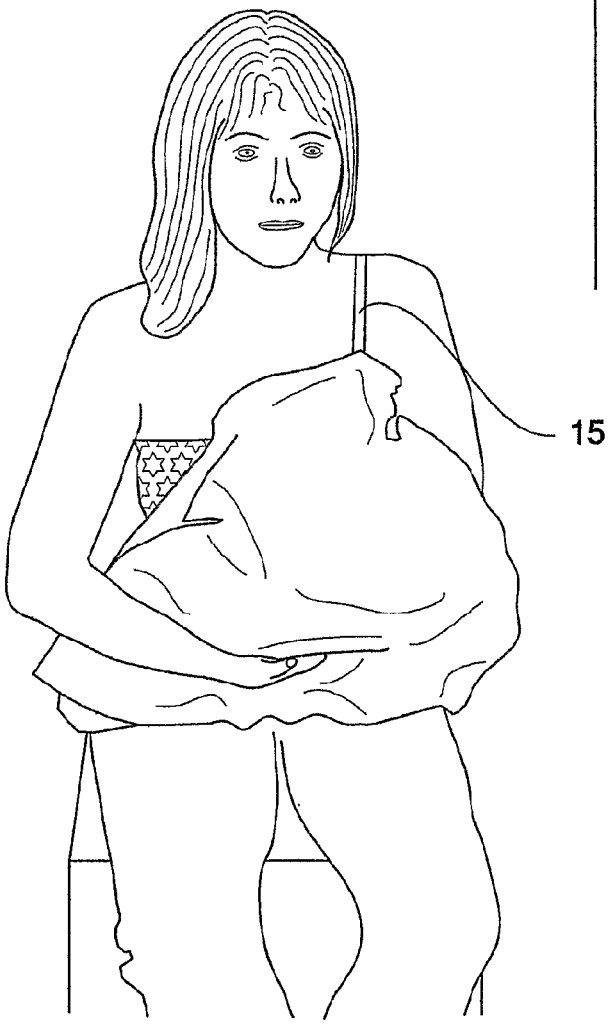
Figure 4C:
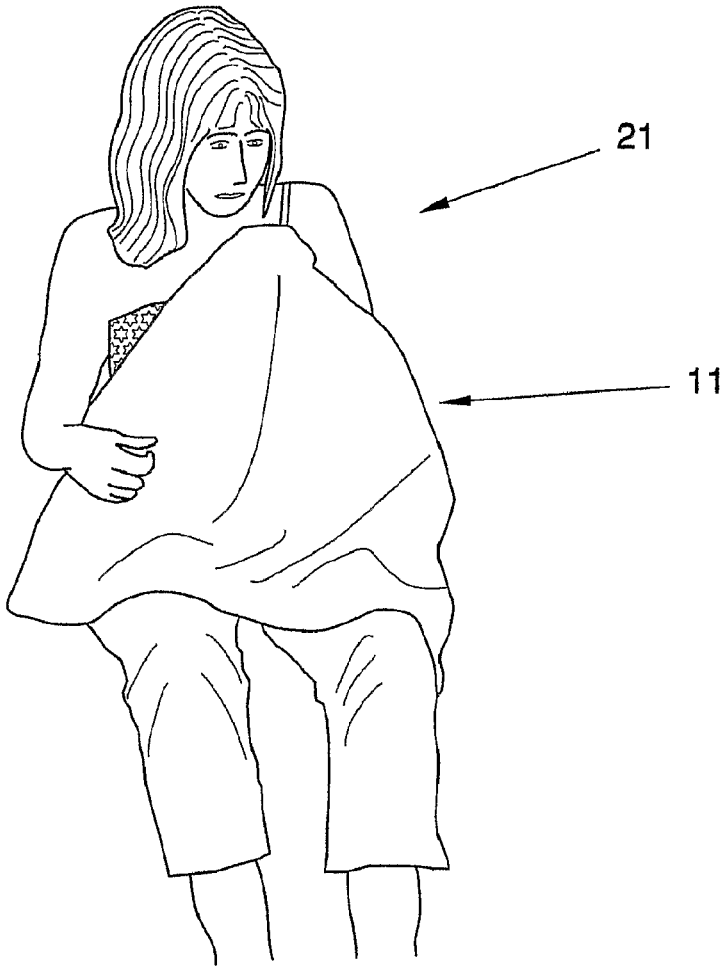
Figure 4D:
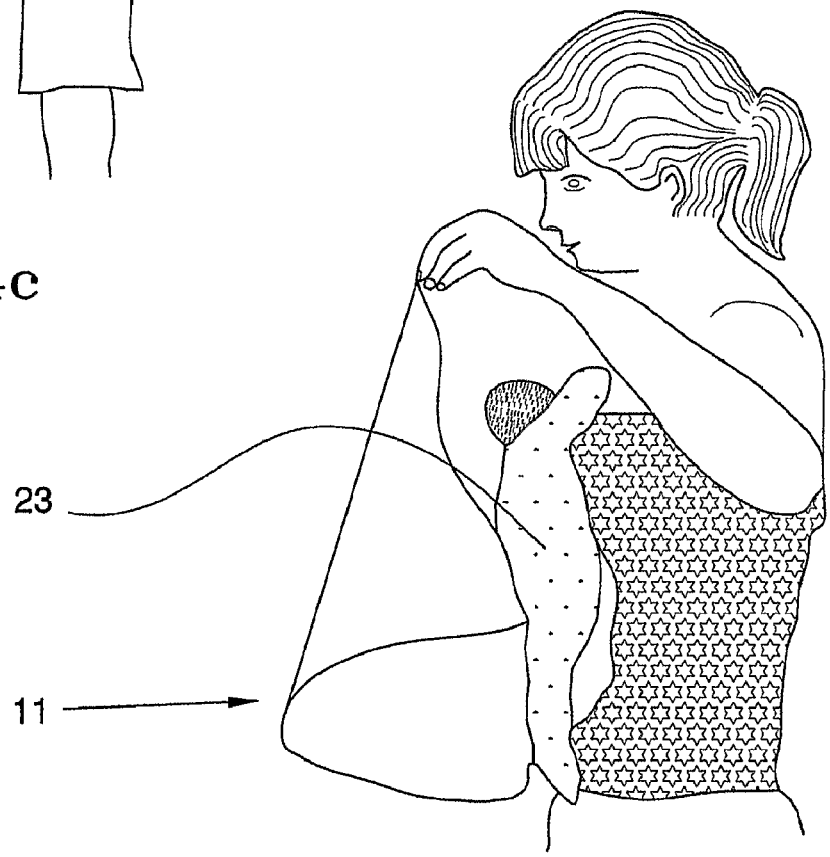
Figure 4E:
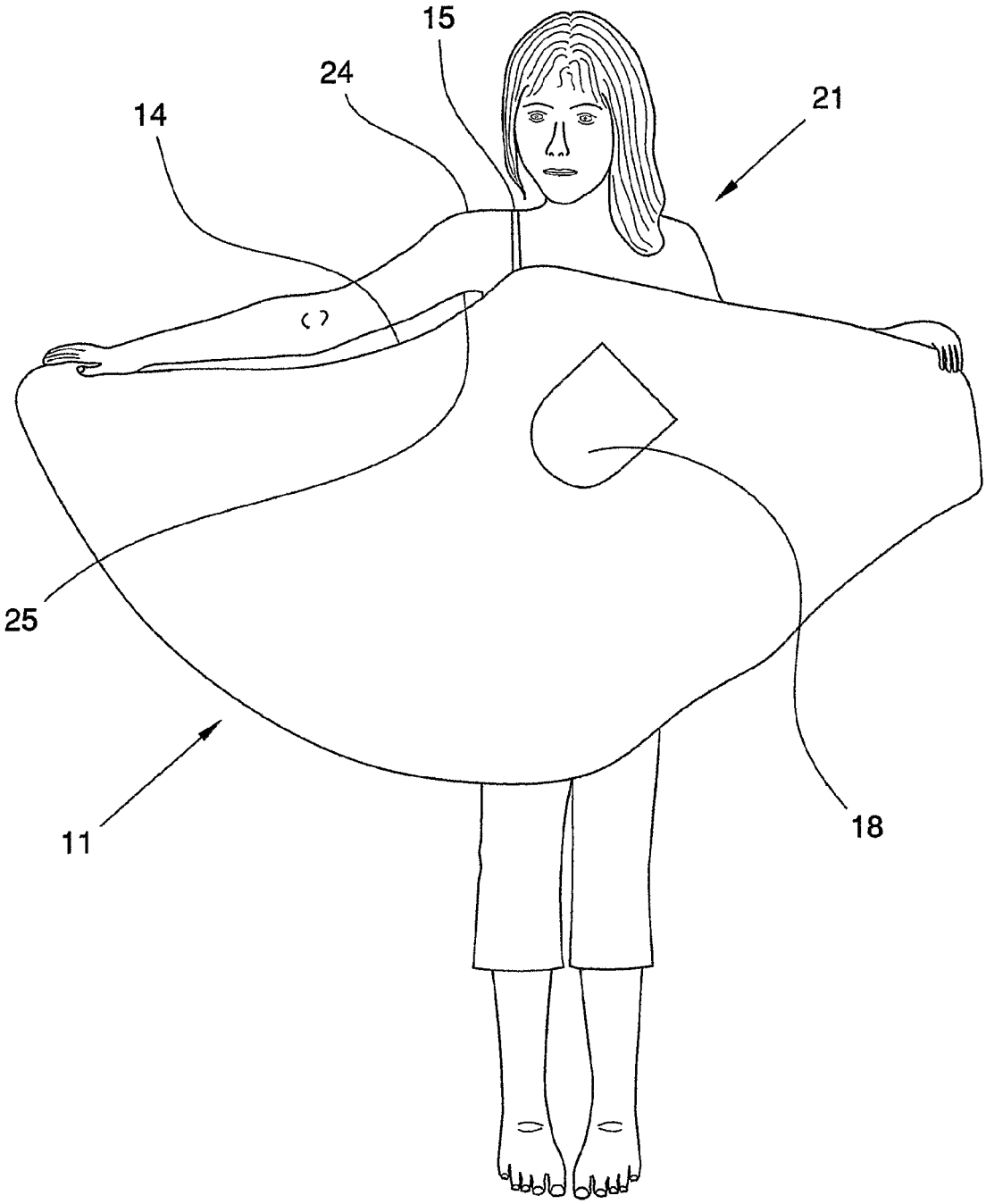
Figure 4F:
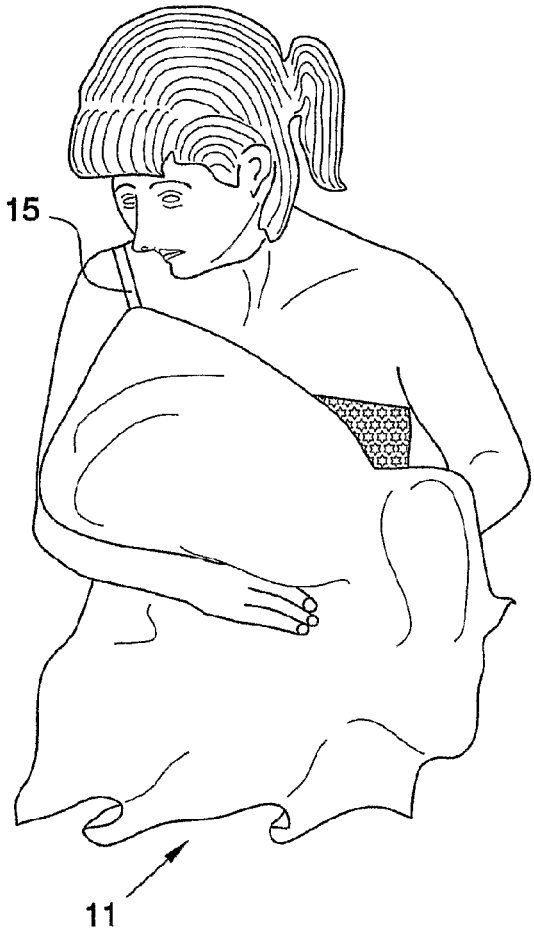
Figure 4G:
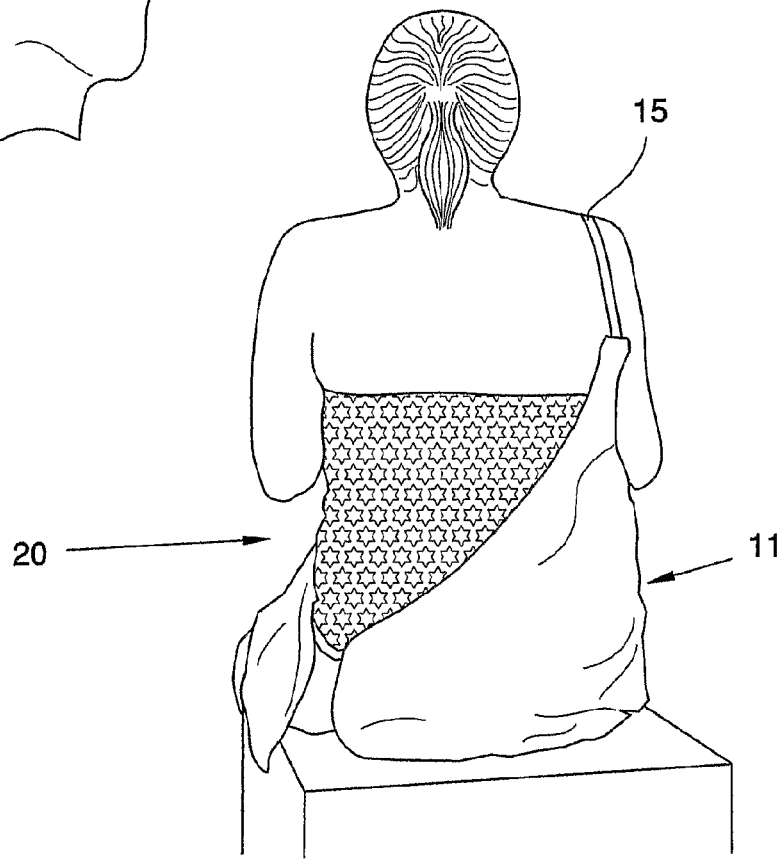
Figure 4H:
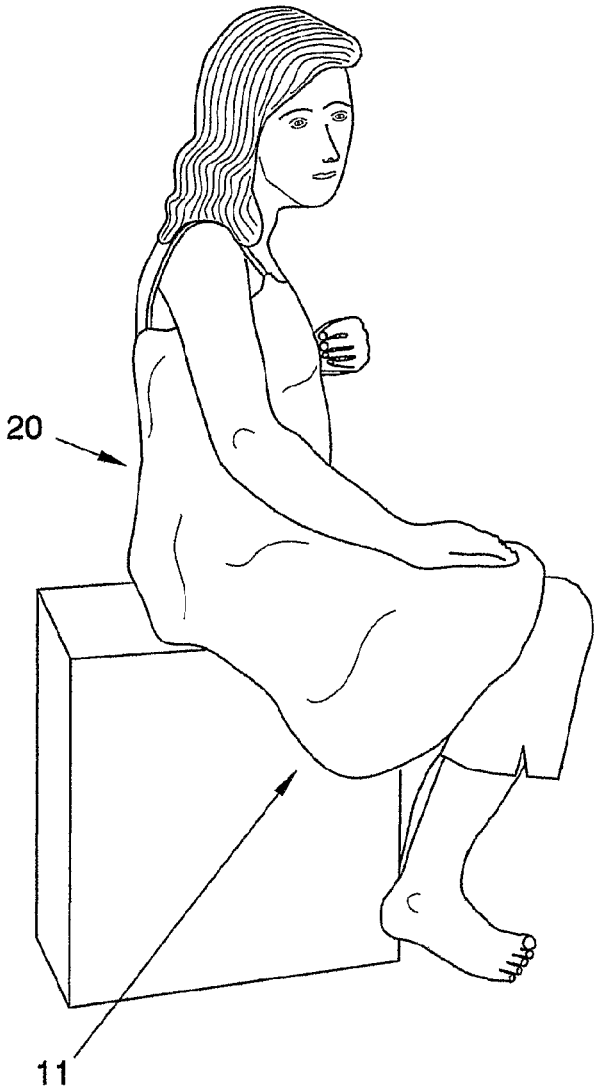
Figure 4I:
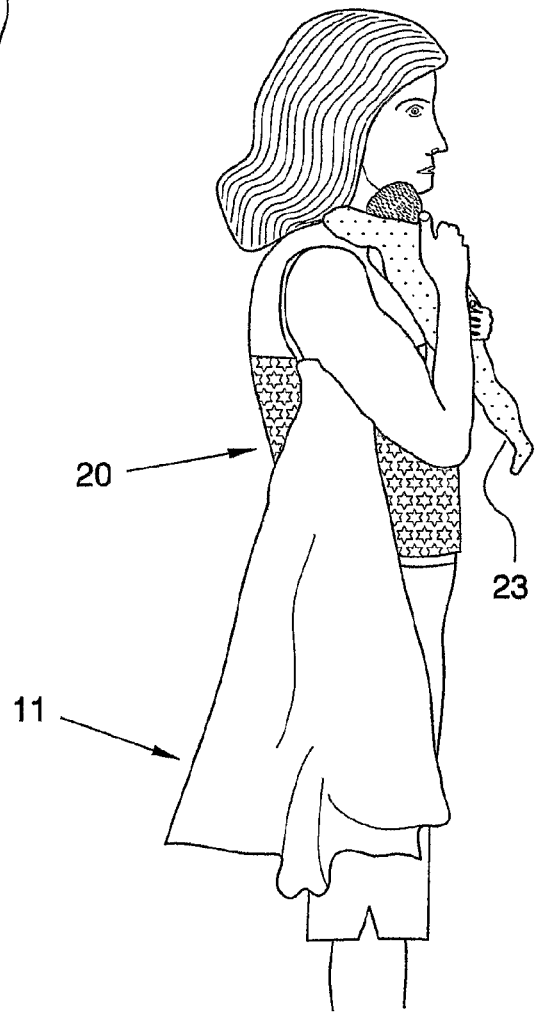

FIG. 3 depicts the cover about to be wrapped about the torso 20 of the mother 21, in this case with the strap 15 of the cover 11 fitted over the left shoulder 22. The position of the pocket 18 for removing a nursing pad therefrom, is thus apparent.

FIG. 4, is a series of photographs, showing the way in which the cover 11 of FIG. 1 is utilised for breast feeding. Item 1 shows the cover 11 draped about the mother's torso 20 for bonding between mother 21 and infant 23, whilst items 2 and 3 show how the infant 23 feeds discretely beneath the cover 11. Item 4 shows how the mother 21 has a view of the infant 23 beneath the cover 11 whilst maintaining discrete feeding. Item 5 shows the overall shape of the cover 11 and location of the pocket 18 in relation to the way the cover 11 is fitted to the mother 21 ready to be wrapped about the torso 20, the strap 15 having been fitted in this case over the mother's right shoulder 24. It will be observed that the cut-away portion 14 described above is located in the vicinity of the right armpit 25 in this case so that when the cover 11 is wrapped around the torso 20 and under the armpit 25, the cutaway portion 14 allows for comfortable fitment in that region. Items 6 to 9 show the cover 11 draped about the torso 20 from different angles.

The foregoing describes only some embodiments of the present invention, and modifications obvious to those skilled in the art can be made thereto without departing from the scope of the present invention.

The invention claimed is:

1. A cover for use in breast feeding or bottle feeding an infant, wherein the cover is formed from a sheet of fabric shaped so that it may be comfortably draped around a mother's torso during breast feeding in order to allow discrete breast feeding of an infant, the cover being provided with a single strap means to fit over a shoulder of the mother to prevent the cover from falling away from the torso and wherein the strap is provided with adjustment means, so that it may fit a variety of sized women, wherein the cover is shaped in generally arcuate fashion, being derived from a sector of a circle, comprising about one third to one half of a notional circle of fabric, and wherein the shoulder strap is attached at points on the cover along the sides corresponding to the radii of the sector and generally located in the vicinity of the centre of that notional circle.

2. A cover for use in breast feeding or bottle feeding an infant according to claim 1, wherein the strap is permanently fixed to the cover, so that in use, an arm of the mother is able to be inserted through the space between the strap and cover so as to fit the cover to the mother by placing the strap over the shoulder.

3. A cover for use in breast feeding or bottle feeding an infant according to claim 2, wherein the strap is attached permanently to the cover by one end thereof only, the other end of the strap being detachable from the cover to facilitate fitment or adjustment of the cover.

4. A cover for use in breast feeding or bottle feeding an infant according to claim 2, wherein the strap comprises two portions, each joined to the cover and which can be joined to form the shoulder strap using hook and loop attachment means, tying or by utilising a buckle arrangement.

5. A cover for use in breast feeding or bottle feeding an infant according to claim 1, in which the cover is provided with one or more pockets formed therein or otherwise attached thereto.

6. A cover for use in breast feeding or bottle feeding an infant according to claim 5, wherein the one or more pockets are of a suitable size so as to accommodate at least one or more nursing pads.

7. A cover for use in breast feeding or bottle feeding an infant according to claim 6, wherein at least two pockets are provided, one each on opposite sides of the cover to allow versatility in use thereby allowing the cover to be effectively reversible.

8. A cover for use in breast feeding or bottle feeding an infant according to claim 5, in which the one or more pockets are formed by sewing, bonding or gluing of the fabric or fabrics from which the cover and pockets are formed.

9. A cover for use in breast feeding or bottle feeding an infant according to claim 1, in which the fabric forming the cover is a single sheet of fabric.

10. A cover for use in breast feeding or bottle feeding an infant according to claim 1, in which the fabric forming the cover is made from two or more plies of fabric or sheeting joined by sewing, bonding or gluing.

11. A cover for use in breast feeding or bottle feeding an infant according to claim 10, in which the respective fabrics are chosen to that the inner side in use is a soft absorbent fabric, and the other side is more a resistant or non permeable fabric, including one which is water proof or moisture resistant.

12. A cover for use in breast feeding or bottle feeding an infant according to claim 11, in which the material for the cover is a woven or knitted fabric structure, or other textile fabrics including felts and non-woven fabrics, flexible plastics sheeting, or "space" blanket material having a shiny metallic like surface on one side.

13. A cover for use in breast feeding or bottle feeding an infant according to claim 10, wherein the fabric of the cover is essentially opaque.

14. A cover for use in breast feeding or bottle feeding an infant according to claim 10, wherein the material of the cover allows some visual contact between mother and infant without necessarily compromising the use of the cover.

15. A cover for use in breast feeding or bottle feeding an infant according to claim 1, wherein the area around the attachment point of the shoulder strap is shaped so as to provide a more comfortable fit for the cover as it passes across the torso and thence around and under the armpit of the mother, by providing a cut-out portion generally along one radii of the sector forming the overall shape of the cover.

* * * * *